US007793452B1

(12) United States Patent
Samson et al.

(10) Patent No.: US 7,793,452 B1
(45) Date of Patent: Sep. 14, 2010

(54) MODULAR FORE-END RAIL ASSEMBLY WITH LOCKING MECHANISM

(75) Inventors: Scott W. Samson, Spofford, NH (US); Kenneth Lankarge, West Hartford, CT (US)

(73) Assignee: Samson Manufacturing Corporation, Whatley, MA (US)

( * ) Notice: Subject to any disclaimer, the term of this patent is extended or adjusted under 35 U.S.C. 154(b) by 0 days.

(21) Appl. No.: 12/357,758

(22) Filed: Jan. 22, 2009

Related U.S. Application Data

(60) Provisional application No. 61/022,627, filed on Jan. 22, 2008.

(51) Int. Cl.
*F41C 23/00* (2006.01)

(52) U.S. Cl. ..... 42/72; 42/71.01; 42/75.01; 89/14.1

(58) Field of Classification Search ..... 89/14.1; 42/85, 75.01, 75.02, 71.01, 72, 124, 112; D22/108; 403/109.1, 109.3, 109.6, 378, 403/379.2, 362
See application file for complete search history.

(56) References Cited

U.S. PATENT DOCUMENTS

| | | | | |
|---|---|---|---|---|
| 1,115,979 | A | 11/1914 | Sillix | |
| 2,775,166 | A | 12/1956 | Janson | |
| 2,844,710 | A | 7/1958 | Zinsser | |
| 3,227,015 | A * | 1/1966 | Tremblay | 81/177.2 |
| 3,276,377 | A | 10/1966 | Bell | |
| 3,611,606 | A | 10/1971 | Sefried et al. | |
| 3,939,589 | A | 2/1976 | Tellie | |
| 4,027,414 | A | 6/1977 | Felix | |
| 4,085,511 | A | 4/1978 | Kovac | |

(Continued)

FOREIGN PATENT DOCUMENTS

| | | | |
|---|---|---|---|
| DE | 4009012 | A1 | 9/1991 |
| WO | 2006138106 | A2 | 12/2006 |

OTHER PUBLICATIONS

"Talon Arms", http://www.talonarms.com/talonarms/index.php?mainyage=index&cPath=8.

(Continued)

*Primary Examiner*—Stephen M Johnson
*Assistant Examiner*—Daniel J Troy
(74) *Attorney, Agent, or Firm*—Barlow, Josephs & Holmes, Ltd.

(57) ABSTRACT

A modular fore-end rail assembly for a firearm is disclosed. The assembly includes an upper handguard having forward and rearward ends. A dovetail rail extends between the forward and rearward ends. Opposing sidewalls extend outwardly and downwardly from the dovetail rail, respectively. The sidewalls terminate in mounting channels. The rearward end includes a first clamping member. A clamp is removably secured to the rearward end and cooperates with the first clamping member to engage a barrel nut of a firearm. The clamp has an exterior surface including a slidable locking pin movable between a locked position and an unlocked position. A lower handguard includes sidewalls that extend outwardly and upwardly. The sidewalls terminate in mating formations that are configured to be slidably received in the mounting channels. A lock aperture is provided at a rearward end of the lower handguard. The locking pin may be slidably engaged with the lock aperture to selectively retain the lower handguard to the upper handguard.

10 Claims, 9 Drawing Sheets

U.S. PATENT DOCUMENTS

| | | | | |
|---|---|---|---|---|
| 4,205,473 | A | 6/1980 | Wilson | |
| 4,249,315 | A | 2/1981 | Hopson, III | |
| 4,485,871 | A | 12/1984 | Davis | |
| 4,845,871 | A | 7/1989 | Swan | |
| 5,010,676 | A | 4/1991 | Kennedy | |
| 5,062,346 | A | 11/1991 | Greve Hansen et al. | |
| 5,097,614 | A | 3/1992 | Strong | |
| 5,123,329 | A | 6/1992 | Irwin | |
| 5,142,806 | A | 9/1992 | Swan | |
| 5,198,600 | A | 3/1993 | E'Nama | |
| 5,343,650 | A | 9/1994 | Swan | |
| 5,412,895 | A | 5/1995 | Krieger | |
| 5,533,292 | A | 7/1996 | Swan | |
| 5,533,929 | A | 7/1996 | Attridge, Jr. | |
| 5,590,484 | A | 1/1997 | Mooney et al. | |
| 5,826,363 | A | 10/1998 | Olson | |
| 6,453,594 | B1 | 9/2002 | Griffin | |
| 6,490,822 | B1 | 12/2002 | Swan | |
| 6,499,245 | B1 | 12/2002 | Swan | |
| 6,508,027 | B1 | 1/2003 | Kim | |
| D477,855 | S | 7/2003 | Selvaggio | |
| 6,606,813 | B1 | 8/2003 | Squire et al. | |
| 6,618,976 | B1 | 9/2003 | Swan | |
| 6,655,069 | B2 | 12/2003 | Kim | |
| D486,547 | S | 2/2004 | Faifer | |
| 6,779,288 | B1 | 8/2004 | Kim | |
| 6,792,711 | B2 | 9/2004 | Battaglia | |
| 6,839,998 | B1 | 1/2005 | Armstrong | |
| 6,854,206 | B2 | 2/2005 | Oz | |
| 6,895,708 | B2 | 5/2005 | Kim et al. | |
| D507,619 | S | 7/2005 | Shiloni | |
| D507,620 | S | 7/2005 | Swan | |
| D510,120 | S | 9/2005 | Ding | |
| D513,298 | S | 12/2005 | Ding | |
| D513,299 | S | 12/2005 | Ding | |
| D513,633 | S | 1/2006 | Ding | |
| D516,157 | S | 2/2006 | Ding | |
| 7,059,076 | B2 | 6/2006 | Stoner et al. | |
| RE39,465 | E | 1/2007 | Swan | |
| D537,902 | S | 3/2007 | Elkaim | |
| 7,216,451 | B1 * | 5/2007 | Troy | 42/72 |
| D544,063 | S | 6/2007 | Swan | |
| D544,564 | S | 6/2007 | Swan | |
| RE40,216 | E | 4/2008 | Swan | |
| 7,497,149 | B2 * | 3/2009 | Lin | 81/62 |
| 7,523,580 | B1 * | 4/2009 | Tankersley | 42/71.01 |
| 2003/0230022 | A1 | 12/2003 | Battaglia | |
| 2004/0000083 | A1 | 1/2004 | Grant, Jr. | |
| 2006/0260169 | A1 * | 11/2006 | Samson et al. | 42/72 |
| 2008/0092422 | A1 | 4/2008 | Daniel et al. | |

OTHER PUBLICATIONS

"Mount Solutions Plus", http://www.mountsplus.com/miva/merchant.mvc?Store_Code=MSP&Screen=PROD&Product_Code=SMC-COO-007&Category_Code=M4_Accessories&DEN_CRVM_Add=1.

* cited by examiner

MODULAR FORE-END RAIL ASSEMBLY WITH LOCKING MECHANISM

CROSS-REFERENCE TO RELATED APPLICATION

The present patent document claims priority to earlier filed U.S. Provisional Patent Application Ser. No. 61/022,627, filed on Jan. 22, 2008, the entire contents of which are incorporated herein by reference.

BACKGROUND OF THE INVENTION

1. Field of the Invention

The present invention relates generally to a modular fore-end rail assembly for firearms. More specifically, the present invention relates to a modular fore-end rail assembly for retrofitting a firearm that includes an upper handguard portion that is clamped around and supported by the barrel nut and further including a removable lower handguard portion that is mounted onto the upper handguard portion to fully surround the firearm barrel. The lower handguard further includes a locking mechanism to keep it assembled to the upper handguard.

2. Background of the Related Art

In the general field of combat and commercial weaponry, there is a broad range of accessories available for mounting onto standard firearms in order to upgrade the capability of these weapons. One area within the broad scope of available firearms that is of particular interest is the M16/M4 weapon system typically utilized in military or combat settings. Generally, referring to FIGS. 12 and 13, the M16/M4 weapon 100 includes a lower receiver 102, an upper receiver 104, a butt stock 106 extending rearwardly from the upper and lower receivers 102, 104 and a barrel 108 that is attached to the front of the upper receiver 104 and extends in a forward direction. The barrel 108 is held in position on the front of the upper receiver 104 by a barrel nut 110 that is threaded onto a barrel mount located on the front of the upper receiver 104. Most new models of the M16/M4 weapons 100 also include a dovetail rail interface 112 integrally formed along the top of the upper receiver 104. This interface rail 112 provides a convenient mounting point for many of the available accessories for use with the M16/M4 firearm 100 such as scopes, sighting devices, lasers and directed fire devices. Since this rail extends only along the upper receiver 104 the interface it is limited in length to the length of the upper receiver 104. The difficulty is that many military personnel have multiple sighting devices in addition to a variety of lighting devices, accessory handgrips, etc. that could also be attached to the weapon 100 for enhanced use of the weapon 100. In view of the broad range of add on accessories, there is not enough space on the upper receiver 104 to accommodate all of the accessories that the user may desire to use. Accordingly, there is a clear need for integration systems that include additional dovetail rail interfaces in order to support the wide variety of auxiliary equipment that is needed while withstanding the rigors of combat use and abuse.

However, prior art mounting systems often limit access to the receiver 102,104, barrel 108 and barrel nut 110 assembly. This situation is undesirable because it limits servicing of the weapon 100 to qualified weapon smiths with appropriate tools and setting, e.g. an armory.

Accordingly, there is a need for a modular fore-end rail assembly for mounting accessories to a firearm 100 that supports the accessories that allows the lower handguard to be quickly detachable from the upper handguard. There is a further need for a modular fore-end rail assembly that provides an easily removal portion that allows access to the barrel 108 of the firearm 100 without having to remove the entire assembly from the firearm that is operable using only a single hand. Finally, there is a further need for a modular fore-end rail assembly that can be mounted to a firearm that derives its structural support entirely from the upper receiver 104 of the firearm 100 while not requiring the replacement of modification of the existing barrel nut 110, yet still retains an easily removable portion for servicing the barrel 108.

SUMMARY OF THE INVENTION

In this regard, the present invention provides for modular fore-end rail assembly that is mounted onto a firearm that serves both as a handguard system and as an integrated interface system for mounting attachments thereto. The present invention is particularly directed to an improved modular fore-end rail assembly that includes a locking mechanism to enable quick detachment of the lower handguard or lower firearm accessory for access to the barrel without requiring the removal of the entire assembly from the firearm. The modular fore-end rail assembly further provides for a lower handguard that may be easily removed with a single hand. Further, by providing for the easy removal of the lower handguard, other auxiliary devices may be mounted to the upper handguard. For example, an M203 grenade launcher can be mounted to the upper handguard in place of the lower handguard portion.

BRIEF DESCRIPTION OF THE DRAWINGS

These and other features, aspects, and advantages of the present invention will become better understood with reference to the following description, appended claims, and accompanying drawings where:

DETAILED DESCRIPTION OF THE PREFERRED EMBODIMENT

Figure 1:
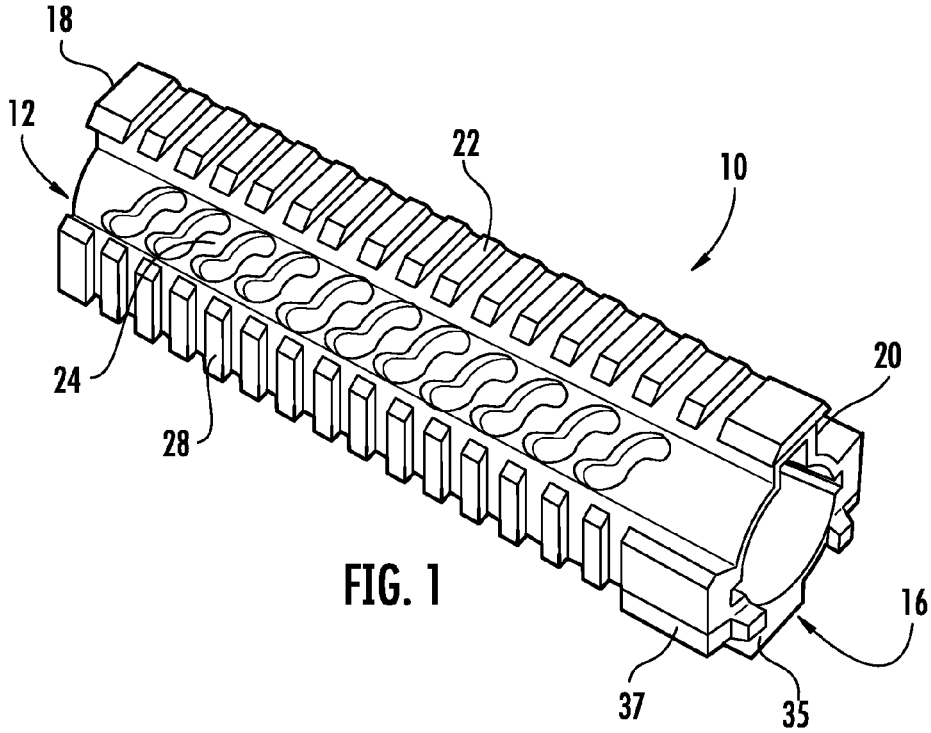
FIG. 1 is a top perspective view of the modular fore-end rail assembly of the present invention.
Figure 2A:
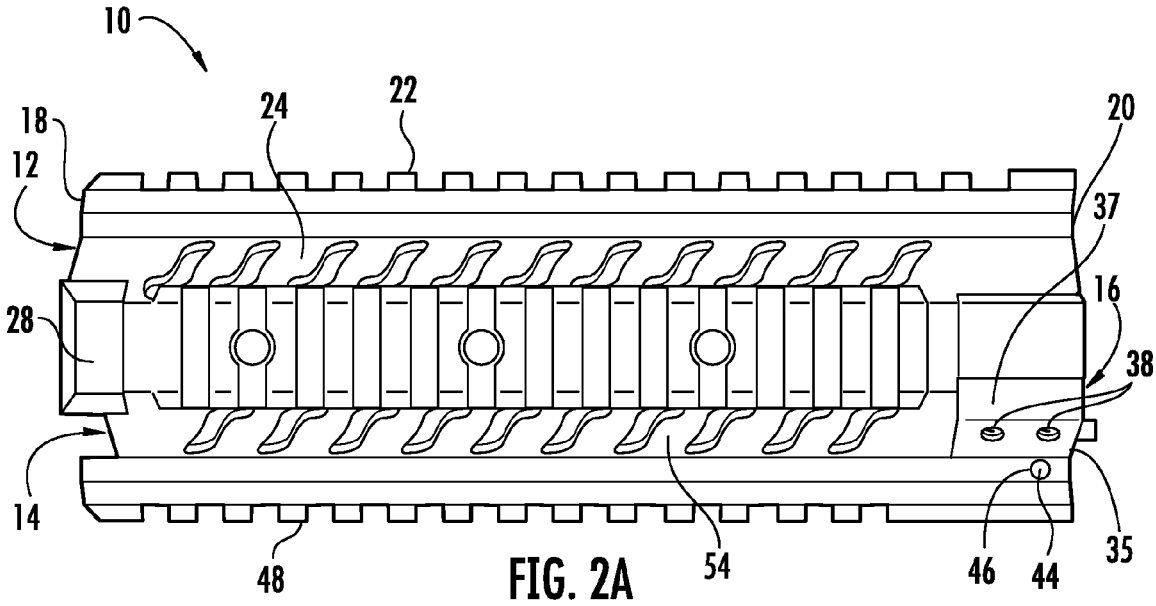
FIG. 2A is a left side view of the modular fore-end rail assembly of the present invention with the lower handguard portion slid fully back in place.
Figure 2B:
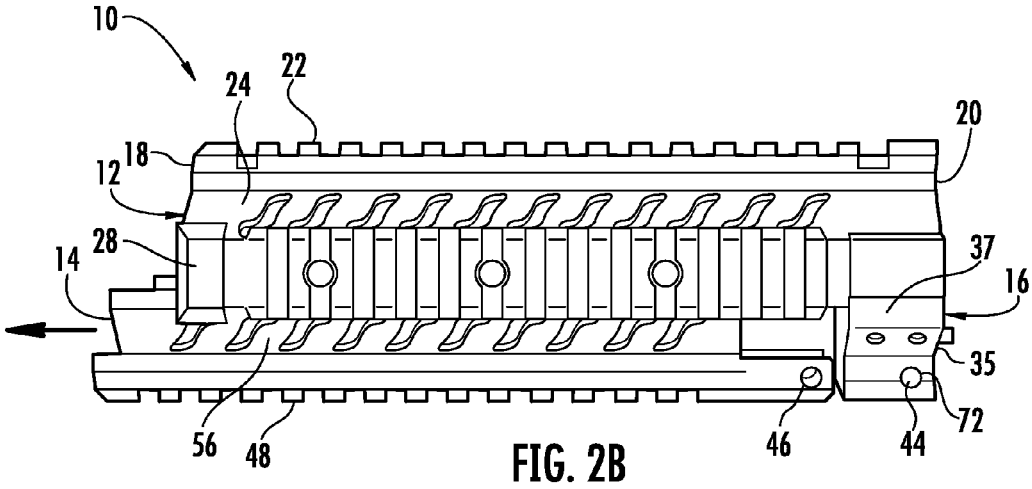
FIG. 2B is a left side view of the modular fore-end rail assembly of the present invention showing how the lower handguard portion slides forwards to be removed.
Figure 3A:
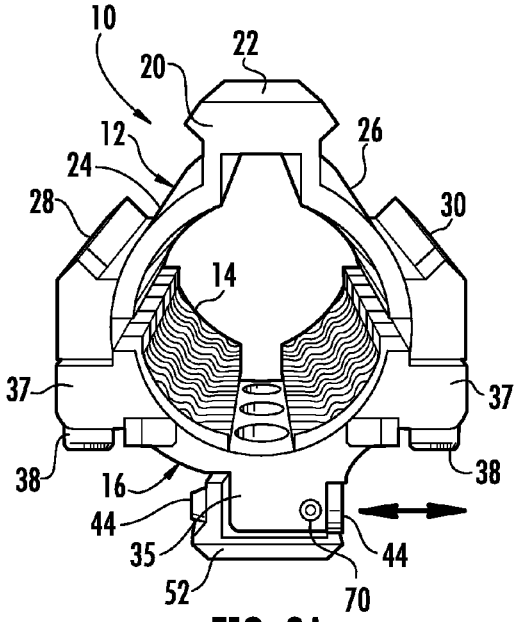
FIG. 3A is a rear end view of the of the modular fore-end rail assembly of the present invention showing the locking pin slid in place.
Figure 3B:
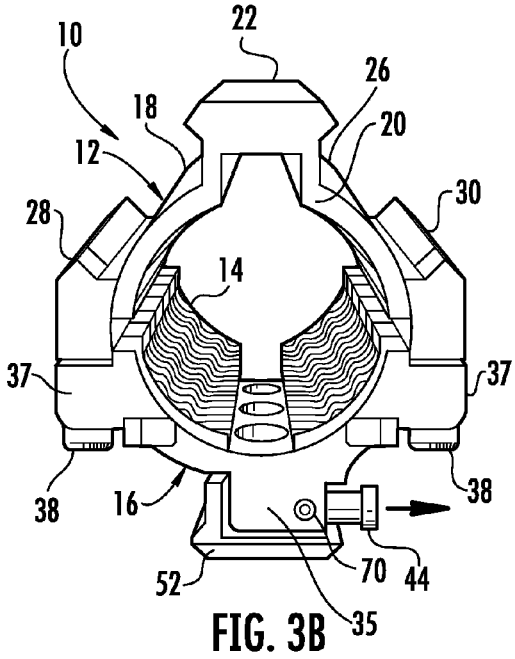
FIG. 3B is a rear end view of the modular fore-end rail assembly of the present invention showing how the locking pin slides out to allow the lower handguard portion to be removed.
Figure 4:
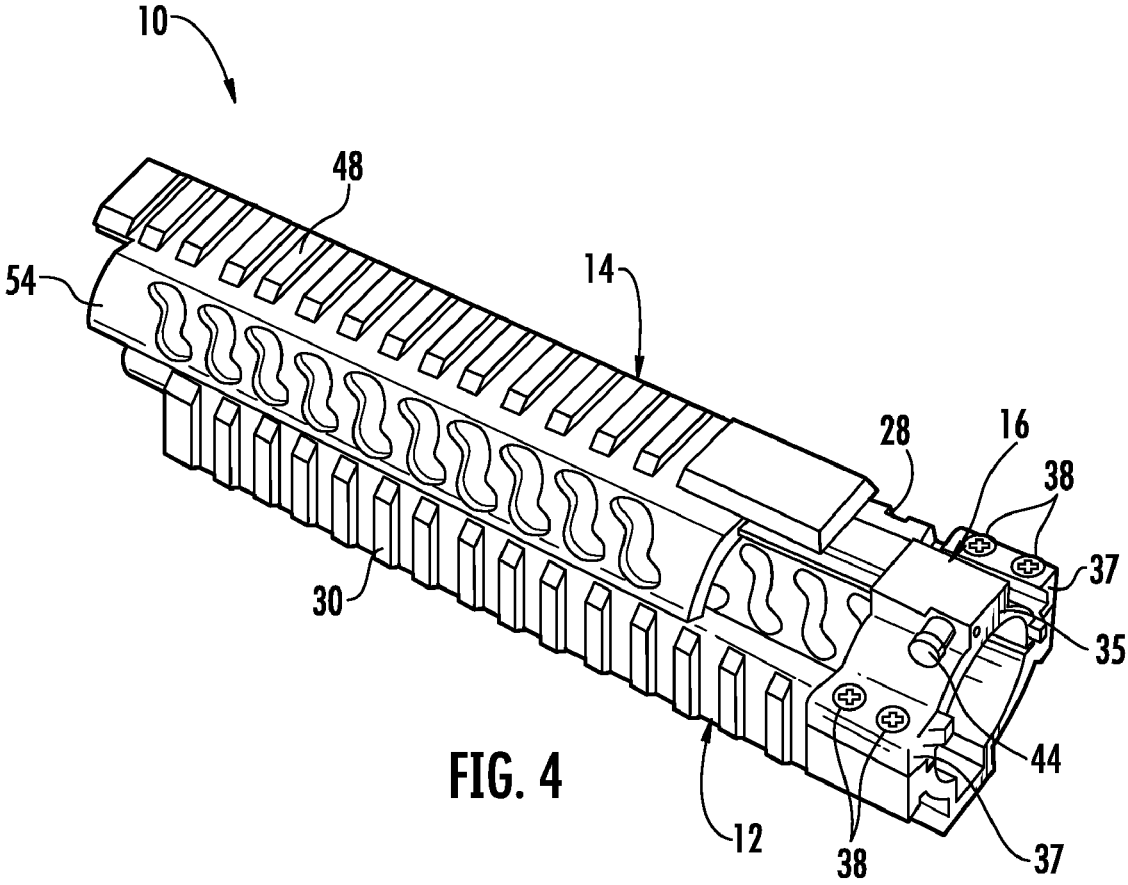
FIG. 4 is a bottom perspective view of the modular fore-end rail assembly of the present invention showing how the lower handguard portion slides forwards to be removed.

Referring now to FIGS. 1, 2A and 2B, the modular fore-end rail assembly 10 of the present invention generally includes an upper handguard portion 12, a lower handguard portion 14 and a clamping assembly 16.

Figure 5:
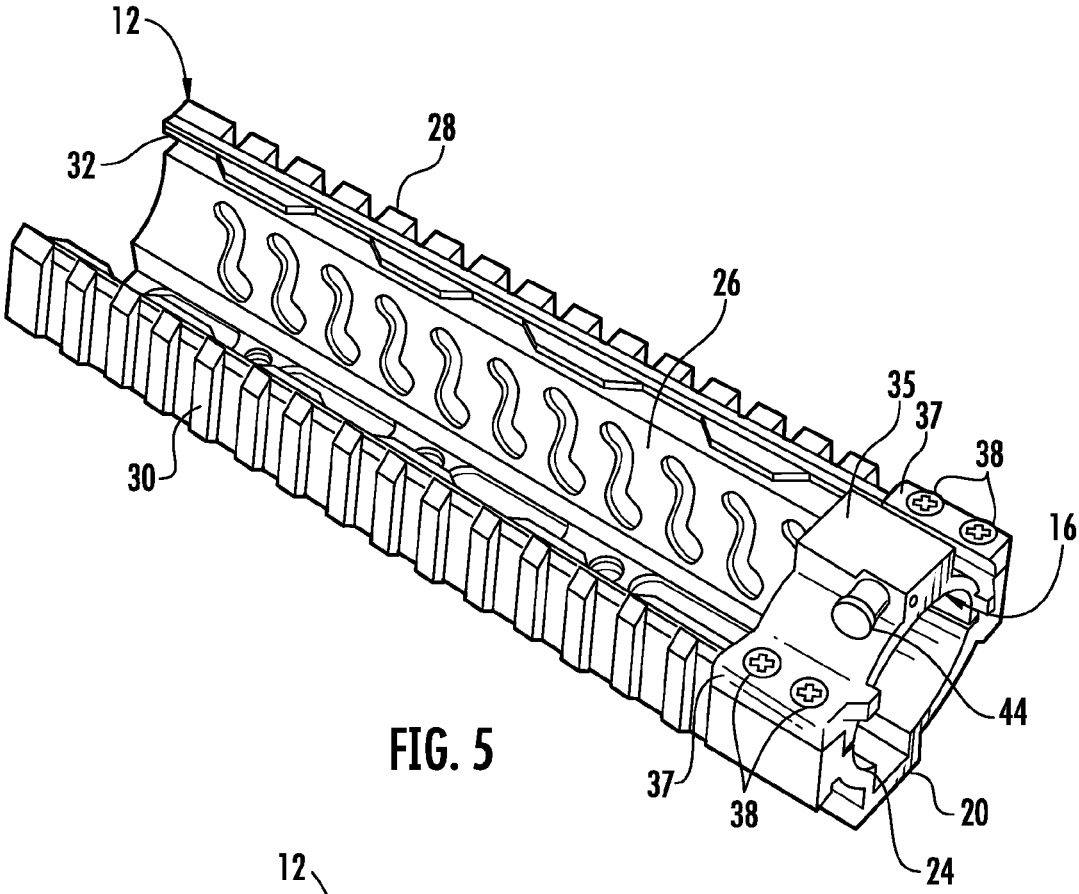
FIG. 5 is a bottom perspective view of the modular fore-end rail assembly of the present invention showing how the lower handguard portion slides forwards with the lower handguard piece removed.
Figure 6:
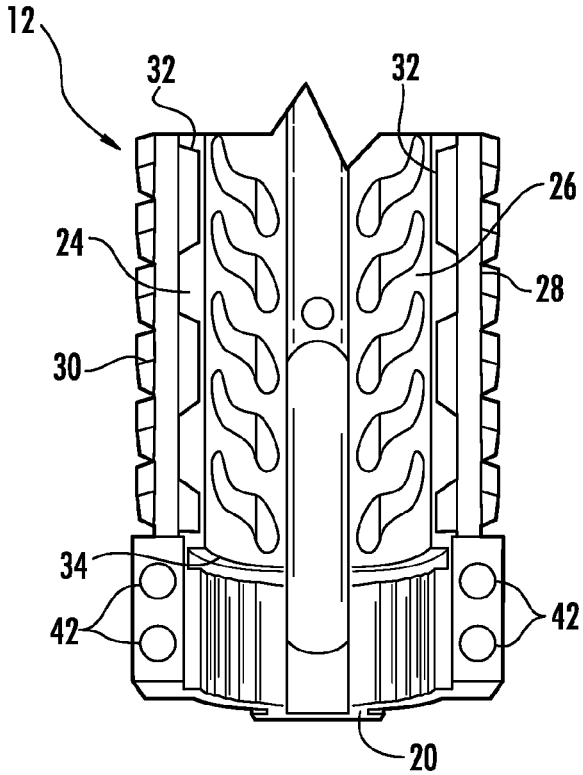
FIG. 6 is a partial bottom view of the rear end of the upper handguard portion.
Figure 7A:
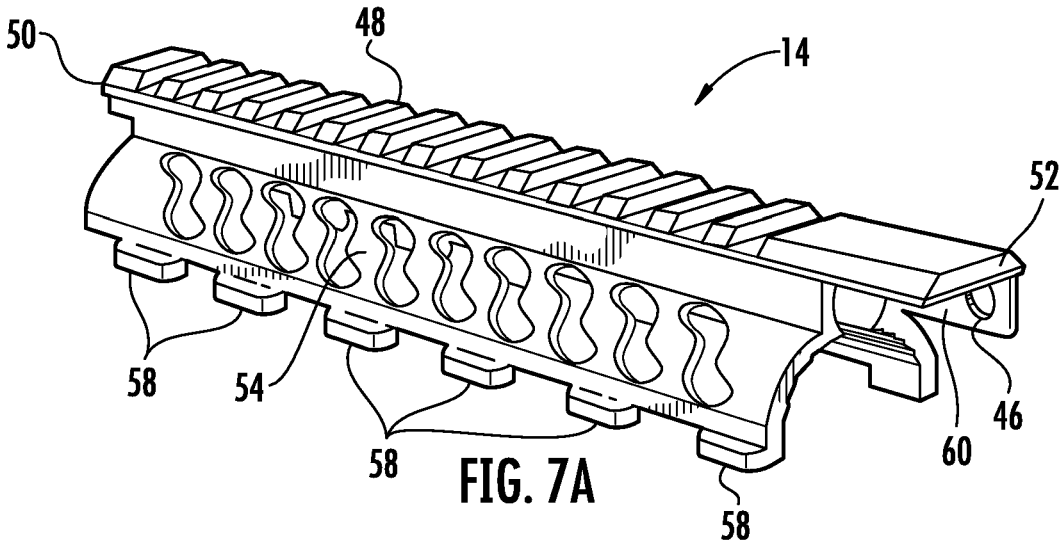
FIG. 7A is a right-side bottom perspective view of the lower handguard portion.
Figure 7B:
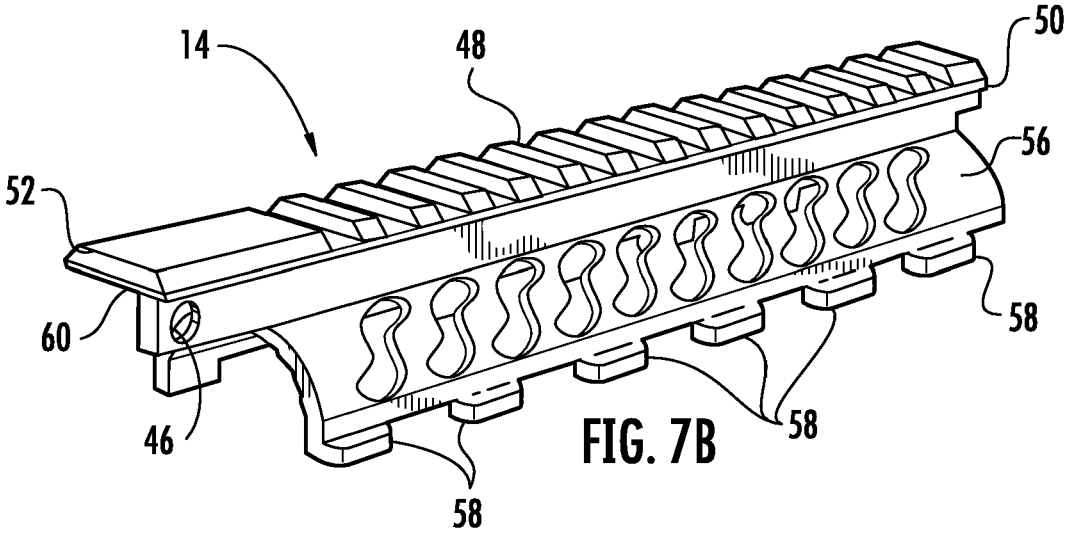
FIG. 7B is a left-side bottom perspective view of the lower handguard portion.
Figure 8:
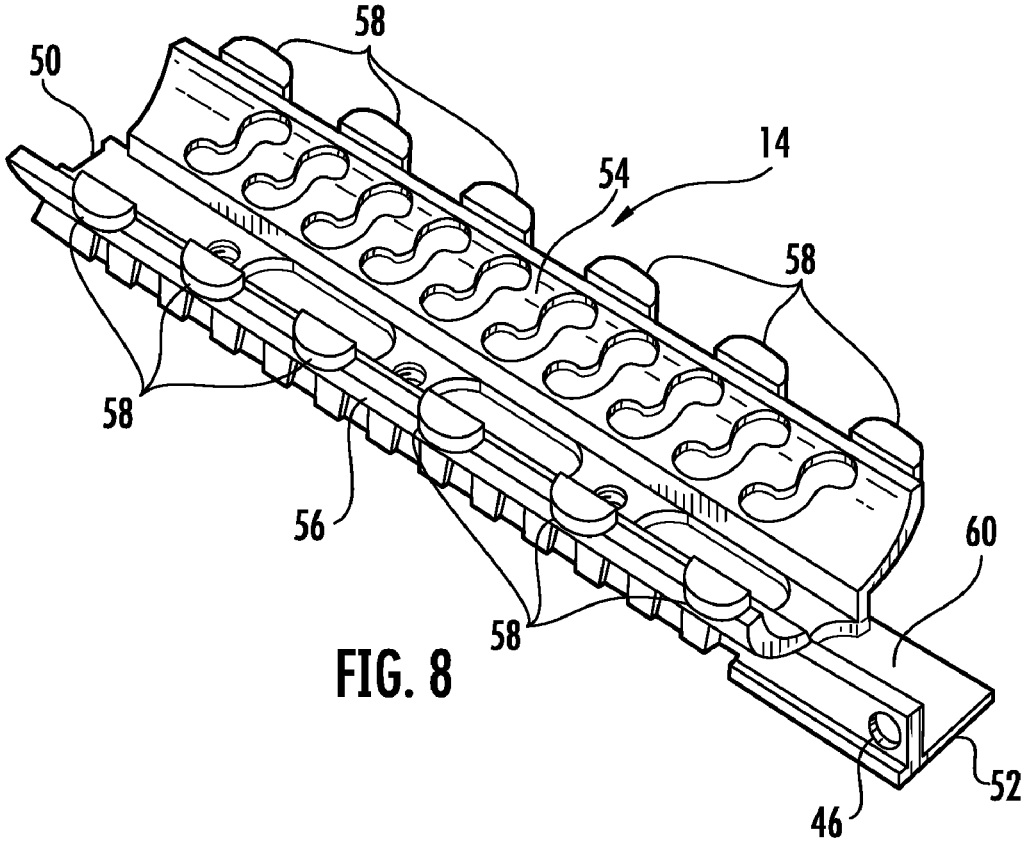
FIG. 8 is a top perspective view of the lower handguard portion.

The upper handguard portion 12 is the structural element that supports the entire modular assembly 10. The upper handguard portion 12 is formed generally as the upper half of a tubular enclosure that is configured to encircle the barrel of the firearm when in a mounted position. The upper handguard portion 12 has a forward end 18 and a rearward end 20 and a standard dovetail rail 22 extending longitudinally between the forward end 16 and the rearward end 18. The upper handguard portion 12 has left and right side walls 24, 26 that extend generally outwardly and downwardly from the dovetail rail 22 forming the upper half of the tubular enclosure. The left and right side walls 24, 26 each have an interior and exterior surface and the walls 24, 26 each terminate at their lower ends with additional dovetail rail interfaces 28, 30 extending along the exterior surface thereof and a channel formation 32 on the interior surface thereof, best seen in FIGS. 5 and 6. The channel formations 32 as will be described in more detail are provided to receive and retain the lower handguard portion 14. Also included is a groove 34 on the interior surface configured to receive and capture the flange on a barrel nut, best seen in FIG. 6.

A clamping assembly 16 is provided at the rearward end portion 20 of the upper handguard portion 12 in order secure the upper handguard portion 12 to the firearm. Generally, the clamping assembly 16 includes a clamp 35 configured to cooperate with the rearward end portion 20 of the upper handguard portion 12 to engage the existing barrel nut on the fire arm and serves to support the entire assembly by engaging the barrel nut. The clamp 35 has a central semi-circular recess 36 therein and flanges 37 extending out to each side thereof. The clamp 35 is attached to the rearward end portion 20 of the upper handguard portion 12 with fasteners 38 that are inserted through openings 40 in the flanges 37 on the clamp 35 and into threaded holes 42 in the side walls 24, 26 of the upper handguard portion 12. When the fasteners 38 are installed and tightened, the clamping assembly 16 is drawn to the upper handguard portion 12 and the two components cooperate to engage the barrel nut as well as the serrated flange on the end of the barrel nut. This mounting configuration allows the clamp 35 and upper handguard portion 12 to be mounted rigidly onto the firearm while deriving all of the required structural support from the front of the upper receiver and barrel nut and eliminating any need to engage the barrel of the firearm. All of the weight of the modular fore-end rail assembly 10 and accessories that are mounted thereto is transferred effectively to the upper receiver thereby protecting the barrel from any additional transfer of load or shock.

Further, while fasteners 38 are shown extending through the clamping assembly 16 and into the upper handguard portion 12, it should be appreciated that the fasteners 38 could also extend from the upper handguard portion 12 and into the clamping assembly 16 and still fall within the disclosure of the present invention.

The clamping assembly 16 also includes a sliding locking pin 44 received in a locking pin channel 72 to engage an aperture 46 on the lower handguard portion 14 as will be described in detail below.

When the upper handguard portion 12 is assembled with the upper receiver, the dovetail rail of the upper handguard portion 12 is arranged so that it extends forwardly in linear alignment with the dovetail rail of the upper receiver to form a continuous rail extending over the barrel.

The lower handguard portion 14 is formed in a semi-circular shape that is complimentary to the upper handguard portion 12 and completes a tubular enclosure around the barrel of the firearm when the lower handguard portion 14 is mounted to the upper handguard portion 12. The lower handguard portion 14 generally includes a longitudinal rail interface 48 extending from a front end portion 50 to a rear end portion 52. The lower handguard portion 14 has side walls 54, 56 that generally extend upwardly and outwardly therefrom and terminate in mating formations 58 or mounting tabs that are shaped and configured to engage the channels 32 along the bottom edges of the sidewalls 24, 26 of the upper handguard portion 12. The lower handguard portion 14 is therefore slidably engaged with the upper handguard portion 12. Further, the rear end of the lower handguard portion includes a key way 60 with an aperture 46 that is shaped to engage the locking pin 44 on the clamping assembly 16 to lend additional stability and structural integrity when the entire assembly 10 is installed on a firearm. The locking pin 44 is provided to allow the clamping assembly 16 to engage the aperture 46 on the lower handguard portion 14 and prevent it from being accidentally dislodged from the upper handguard portion 12. When a user wishes to remove the lower handguard portion 14, the locking pin 44 is moved clear of the aperture 46 and the lower handguard portion 14 is slid forward to disengage it from the upper handguard portion 12 as shown in FIGS. 2A and 2B. A user can use one hand to unlock the locking pin 44 and remove the lower handguard portion 14.

Figure 9:
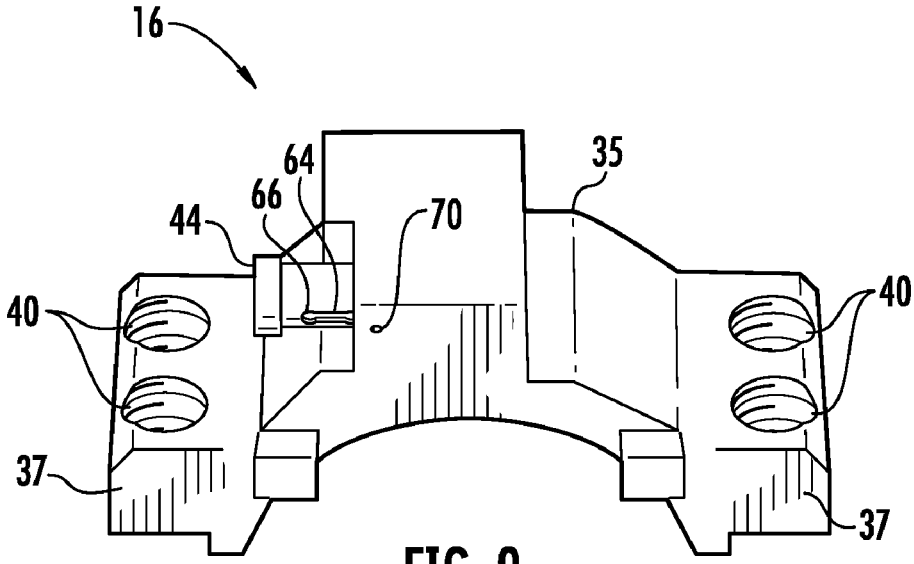
FIG. 9 is a rear bottom perspective view of the clamp assembly.
Figure 10:
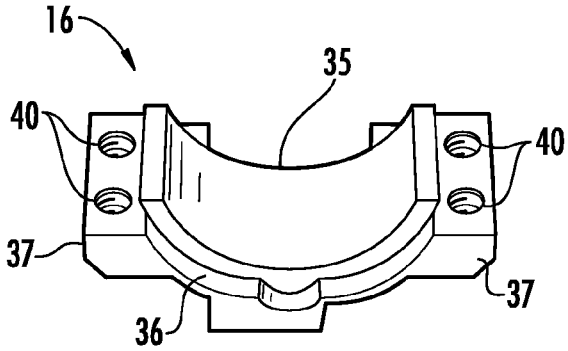
FIG. 10 is a front top perspective view of the clamp assembly.
Figure 11:
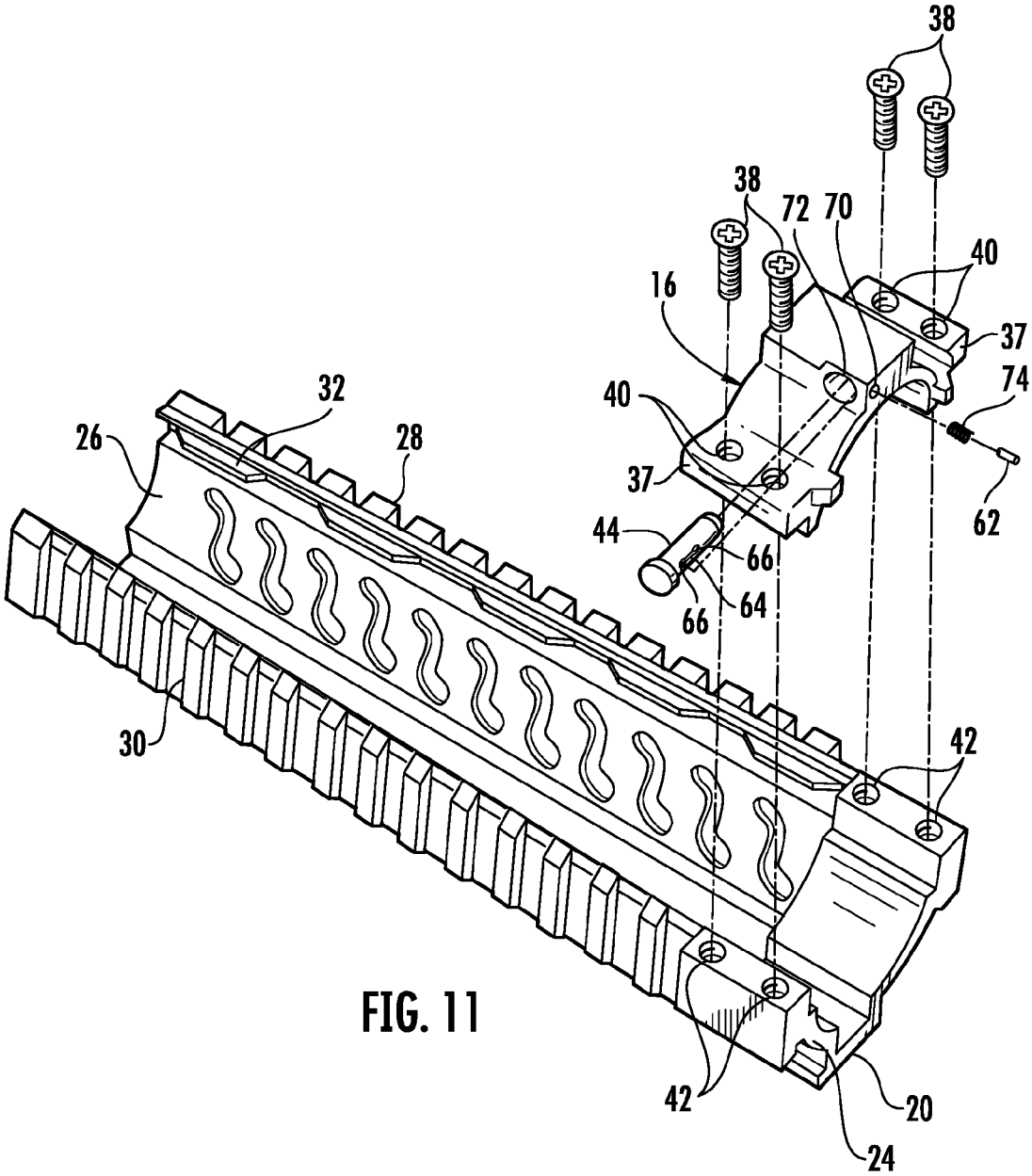
FIG. 11 is an exploded view of the upper handguard portion and clamp assembly.
Figure 12:
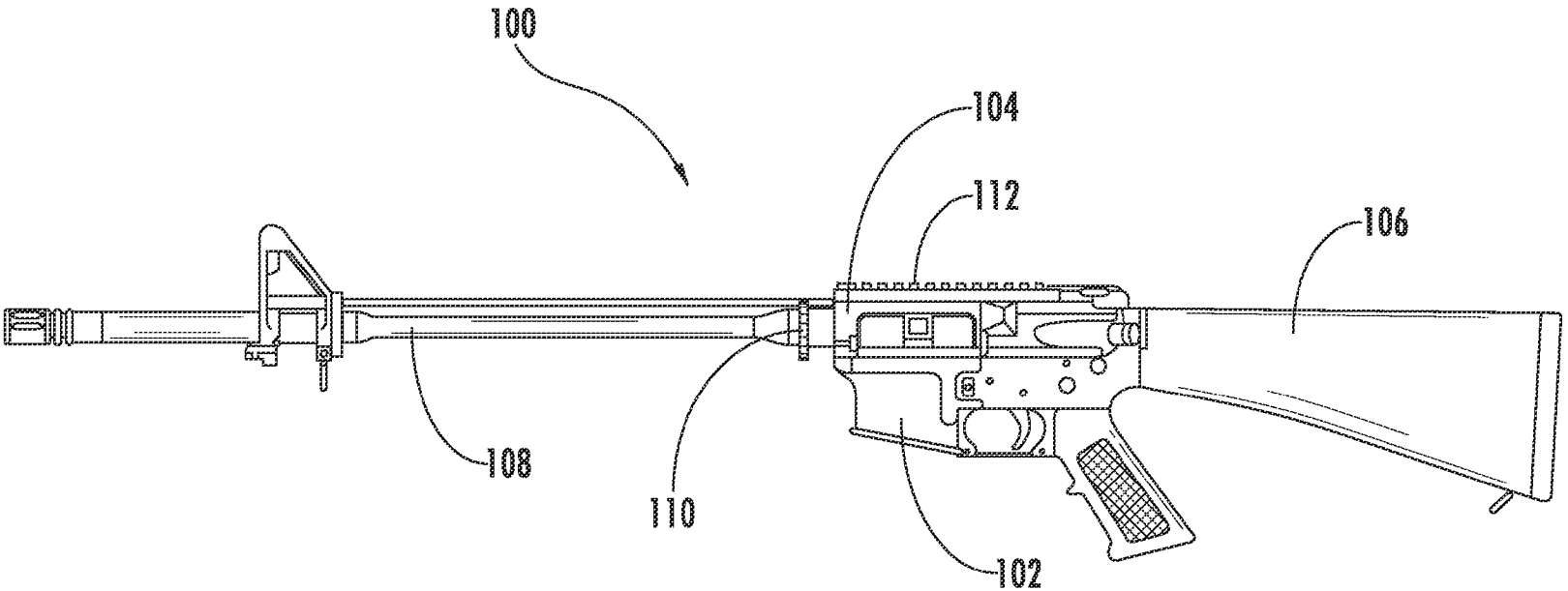
FIG. 12 (PRIOR ART)
FIG. 12 is a side view of a prior M16/M4 type weapon with the handguards removed and the delta ring removed from the barrel nut.
Figure 13:
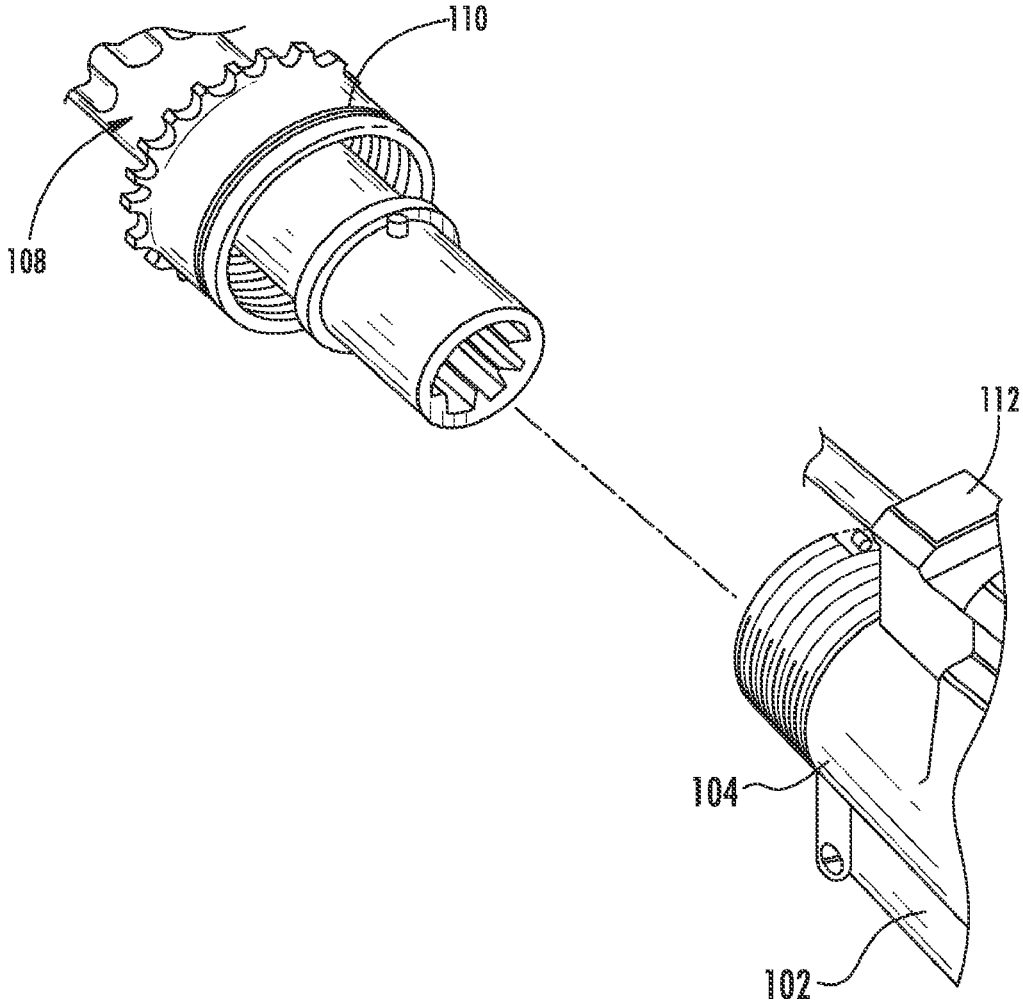
FIG. 13 (PRIOR ART)
FIG. 13 is a partial exploded view of the barrel, barrel nut, barrel mount, and upper receiver of an M16/M4 type weapon.

The locking pin 44 is retained in the locking pin channel 72 of the clamping assembly 16 by a spring-biased retaining pin 62, best seen in FIG. 11. The retaining pin 62 and spring are seated in a channel on the inside of the clamp 35, which is not shown in the figures. The retaining pin 62 includes a rounded head. The locking pin 44 includes a lateral slot 64 connecting two spaced lock holes 66. The locking pin 44 is shown rotated so the slot 64 and lock holes 66 are facing rearwards in FIGS. 9 and 11 for ease of the illustration. However, the lock slot 64 and lock holes 66 would, in fact, be facing towards the forward end portion of the upper handguard portion 12. The lock holes 66 are smaller in diameter than the retaining pin 62 to prevent the retaining pin 62 from becoming lodged within the lock holes 66. The rounded head of the retaining pin 62 travels within the lock slot 64 on the locking pin 44 and becomes seated in either of the lock holes 66. Because the head of the retaining pin 62 becomes seated in the lock holes 66, the locking pin 44 is prevented from becoming easily dislodged from the clamping assembly 16. Moreover, the retaining pin 62 prevents the locking pin 44 from traveling freely within the clamping assembly 16, which could allow the lower handguard portion 14 or firearm accessory to become detached from the upper handguard portion 12. The rounded head of the retaining pin 62 allows a user to easily unseat the retaining pin 62 from the lock holes 66 by applying sufficient force on the locking pin 44 to bias the retaining pin 62 inwardly against a spring 74 in the clamping assembly 16. A release hole 70 on the clamping assembly 16 permits the locking pin 44 and retaining pin 62 to be removed from the clamping assembly 16 for servicing.

Therefore, it can be seen that the present invention provides a unique solution to the problem of providing a modular fore-end rail assembly for mounting accessories to a firearm that supports the accessories that allows the lower handguard to be quickly detachable from the upper handguard. The modular fore-end rail assembly also provides an easily removable portion that allows access to the barrel of the firearm without having to remove the entire assembly from the firearm that is operable using only a single hand. Finally, the modular fore-end rail assembly can be mounted to a firearm and is structurally supported entirely from the upper receiver of the firearm while not requiring the replacement of modification of the existing barrel nut, yet still retains an easily removable portion for servicing the barrel.

It would be appreciated by those skilled in the art that various changes and modifications can be made to the illustrated embodiments without departing from the spirit of the present invention. All such modifications and changes are intended to be within the scope of the present invention.

We claim:

1. A modular fore-end rail assembly for a firearm, said firearm including at least an upper receiver having a forward end and a rearward end, said upper receiver having a barrel receiving receptacle at said forward end thereof, said firearm further including a barrel received in said barrel receiving receptacle and a barrel nut received around an outer surface of said barrel receiving receptacle to retain said barrel within said barrel receiving receptacle, said modular fore-end rail assembly comprising:

an upper handguard having a forward end and a rearward end, a dovetail rail extending longitudinally between the forward end and the rearward end, and opposing side walls that extend outwardly and downwardly from said dovetail rail, respectively, said opposing side walls terminating in mounting channels, said rearward end of said upper handguard including a first clamping member;

a clamp removably secured to said rearward end of said upper handguard wherein said clamp cooperates with said first clamping member to engage said barrel nut, said clamp having an exterior surface including a slidable locking pin movable between a fixed locked position and a fixed unlocked position; and a lower handguard including side walls that extend outwardly and upwardly, said side walls terminating in mating formations that are configured to be slidably received in said mounting channels in said upper handguard and a lock aperture at a rearward end thereof, wherein said locking pin may be slidably engaged with said lock aperture to selectively retain said lower handguard with said upper handguard, said locking pin includes a surface defining slot interconnecting a pair of recessed surface defining holes configured and arranged to cooperate with a spring-biased retaining pin contained in said clamp to selectively hold said locking pin in said locked position and said unlocked position.

2. The article of claim 1, wherein said locking pin is oriented to slide laterally between the locked position and the unlocked position.

3. The article of claim 1, further comprising a pair of dovetail rails extending from each sidewall, respectively.

4. The article of claim 1, wherein said lower handguard further comprises a dovetail rail depending from said sidewalls and extending from a forward end to a rearward end of said the lower handguard.

5. The article of claim 1, further comprising a plurality of surface defining vent holes through said side walls of said upper handguard.

6. The article of claim 5, where said vent holes are substantially S-shaped.

7. The article of claim 5, where said vent holes are substantially backwards S-shaped.

8. The article of claim 1, further comprising a plurality of surface defining vent holes through said side walls of said lower handguard.

9. The article of claim 8, where said vent holes are substantially S-shaped.

10. The article of claim 8, where said vent holes are substantially backwards S-shaped.

* * * * *